US006501930B2

(12) United States Patent
Oku

(10) Patent No.: US 6,501,930 B2
(45) **Date of Patent: *Dec. 31, 2002**

(54) IMAGE FORMING METHOD AND APPARATUS WITH CONTROLLED IMAGE CARRIER ROTATION DRIVING BASED ON PREVIOUS ROTATION STATE

(75) Inventor: Juntaro Oku, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 09/447,714

(22) Filed: Nov. 23, 1999

(65) Prior Publication Data

US 2002/0012549 A1 Jan. 31, 2002

(30) Foreign Application Priority Data

Nov. 27, 1998 (JP) ..... 10-337213

(51) Int. Cl.[7] ..... G03G 15/00
(52) U.S. Cl. ..... 399/167

(58) Field of Search ..... 399/167

(56) References Cited

U.S. PATENT DOCUMENTS 4,803,515 A * 2/1989 Hoshino et al. ..... 399/167 X
5,790,930 A * 8/1998 Fuchiwaki ..... 399/167 X
5,887,230 A * 3/1999 Sakamaki et al. ..... 399/167
5,933,687 A * 8/1999 Okuno et al. ..... 399/167
5,995,802 A * 11/1999 Mori et al. ..... 399/167 X

* cited by examiner

*Primary Examiner*—Fred L Braun
(74) *Attorney, Agent, or Firm*—Fitzpatrick, Cella, Harper & Scinto

(57) ABSTRACT

An image forming method and apparatus uses an image forming unit including an image carrier and a write unit that forms an image on the image carrier. A moving member moves to transfer, at a transfer position, the image formed on the image carrier and a driving unit rotates and drives the image carrier. A control circuit controls rotation driving of the driving unit on the basis of a rotation state of the image carrier obtained during a predetermined time interval centered on the same rotation position of a preceding rotation as that of a current rotation.

33 Claims, 9 Drawing Sheets

IMAGE FORMING METHOD AND APPARATUS WITH CONTROLLED IMAGE CARRIER ROTATION DRIVING BASED ON PREVIOUS ROTATION STATE

BACKGROUND OF THE INVENTION

1. Field of the Invention

The present invention relates to an image forming apparatus and, more particularly, to control of rotation driving of an image carrier or the like.

2. Related Background Art

A high-speed color image forming apparatus is conventionally known, in which images formed by a plurality of image forming units are overlappingly transferred to a conveyed recording sheet.

An apparatus of this type suffers the following problem. That is, due to mechanical precision, the moving irregularities of a plurality of photosensitive drum and conveyor belt occur and the relationship in moving amount between the conveyor belt and the outer surfaces of the photosensitive drums varies at the transfer positions of the respective image forming units in units of colors. For this reason, the overlapped images of the respective colors do not match resulting in color misregistration (position error).

The color misregistration is mainly classified into shifts in the main scanning and subscanning directions. The shifts include a steady error caused by a constant shift within one image and an unsteady error caused by a periodically varying shift.

The steady error can be conventionally corrected as follows. Position error correction marks are formed on the conveyor belt in units of colors, and position errors are detected on the basis of mark read results, thereby correcting the steady error.

The unsteady color misregistration and particularly misregistration caused by irregular convey operation may be corrected as follows. The rotation states of the photosensitive drums and conveyor belt are monitored, and rotation driving of the motor is so controlled as to cancel the rotation errors and make the rotational speed constant.

Conventionally, rotation driving control data obtained at the time of manufacture are stored in a memory. Rotation driving of the motor is controlled in actual image formation on the basis of the stored control data.

Conventionally, since the control data for canceling rotation errors are stored in the memory in advance, as described above, the control data cannot cope with changes in rotation errors caused by changes in environment of the apparatus and changes with age.

Unsteady shifts occur due to variations in rotation errors, and an excellent image cannot be obtained.

SUMMARY OF THE INVENTION

It is an object of the present invention to solve the conventional problems described above.

It is another object of the present invention to eliminate rotation errors of rotary members in an image forming apparatus to obtain a high-precision image.

In order to achieve the above objects according to an aspect of the present invention, there is provided an image forming apparatus comprising:

image forming means including an image carrier and write means for forming an image on the image carrier;

a moving member which moves to transfer, at a transfer position, the image formed on the image carrier;

driving means for rotating and driving the image carrier; and control means for controlling rotation driving of the driving means on the basis of a rotation state of the image carrier in a predetermined interval centered on the same rotation position of a preceding rotation as that of a current rotation.

The above and other objects, features, and advantages of the present invention will be apparent from the following detailed description of preferred embodiments in conjunction with the accompanying drawings.

DESCRIPTION OF THE PREFERRED EMBODIMENTS

The preferred embodiments of the present invention will be described in detail with reference to the accompanying drawings.

Figure 1:
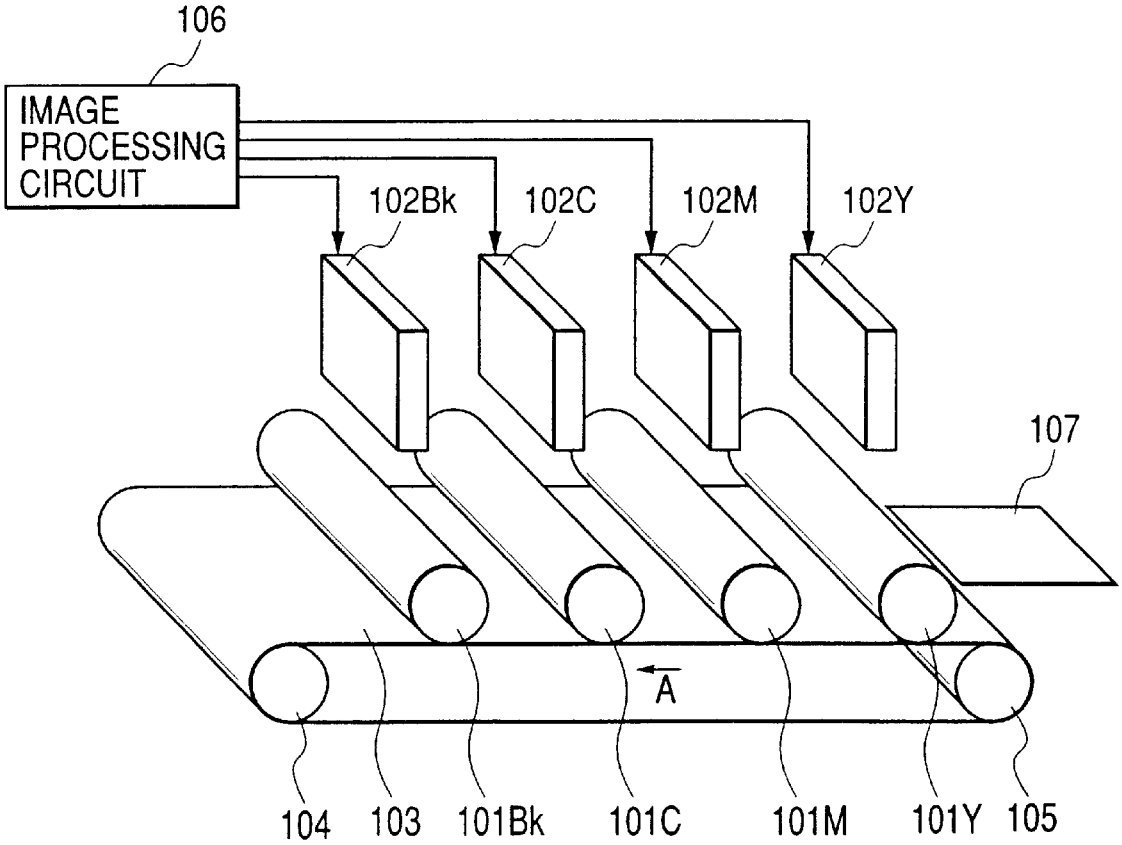
FIG. 1 is a view showing the arrangement of an image forming apparatus to which the present invention is applied.

FIG. 1 is a view showing the arrangement of an image forming apparatus to which the present invention is applied.

The apparatus in FIG. 1 has image forming units for forming four color images, i.e., yellow (to be referred to as Y hereinafter), magenta (to be referred to as M hereinafter), cyan (to be referred to as C hereinafter), and black (to be referred to as BK hereinafter) images, respectively.

Photosensitive drums 101Y, 101M, 101C, and 101BK form Y, M, C, and BK electrostatic latent images, respectively. Driving units (not shown in FIG. 1; to be described later) 200 drive the photosensitive drums 101Y, 101M, 101C, and 101BK, respectively. The photosensitive drums 101Y, 101M, 101C, and 101BK are irradiated with laser beams from optical units 102Y, 102M, 102C, and 102BK to form electrostatic latent images in accordance with image signals from an image processing circuit 106. Each optical unit includes a laser beam source and reflecting mirror. Note that a charger, developing unit, and the like are arranged around each photosensitive drum, as is well known.

A conveyor belt 103 moves in a direction indicated by an arrow A to sequentially convey a recording sheet 107 to the image forming units. A driving roller 104 is connected to the driving unit made up of a motor, gear, and the like (to be described later) and drives the conveyor belt 103. A driven roller 105 is rotated during movement of the conveyor belt 103 to apply a constant tension to the conveyor belt 103. The image processing circuit 106 processes an external input image signal and outputs the image signals of the respective colors to the corresponding optical units.

The image forming operation of the apparatus shown in FIG. 1 will now be described.

In image formation, when the preparation for starting printing images in the respective optical units 102 is complete, a control circuit (not shown) drives a registration roller to convey the recording sheet 107 onto the conveyor belt 103. At the same time, the image processing circuit 106 outputs image signals to the optical units 102 on the basis of the convey start timing of the recording sheet 107.

The optical units 102 form electrostatic latent images on the photosensitive drums 101, respectively. The latent images are developed by developing units (not shown) using color toners, respectively. The toner images are then transferred onto the recording sheet 107 by transfer units (not shown) at the corresponding transfer positions. The apparatus shown in FIG. 1 transfers the images in an order of Y, M, C, and BK. The recording sheet 107 is separated from the conveyor belt 103. The toner images on the recording sheet 107 are fixed by a fixing unit (not shown). The resultant recording sheet is delivered outside the apparatus.

Rotation control for the photosensitive drums of this embodiment will be described below.

Figure 2:
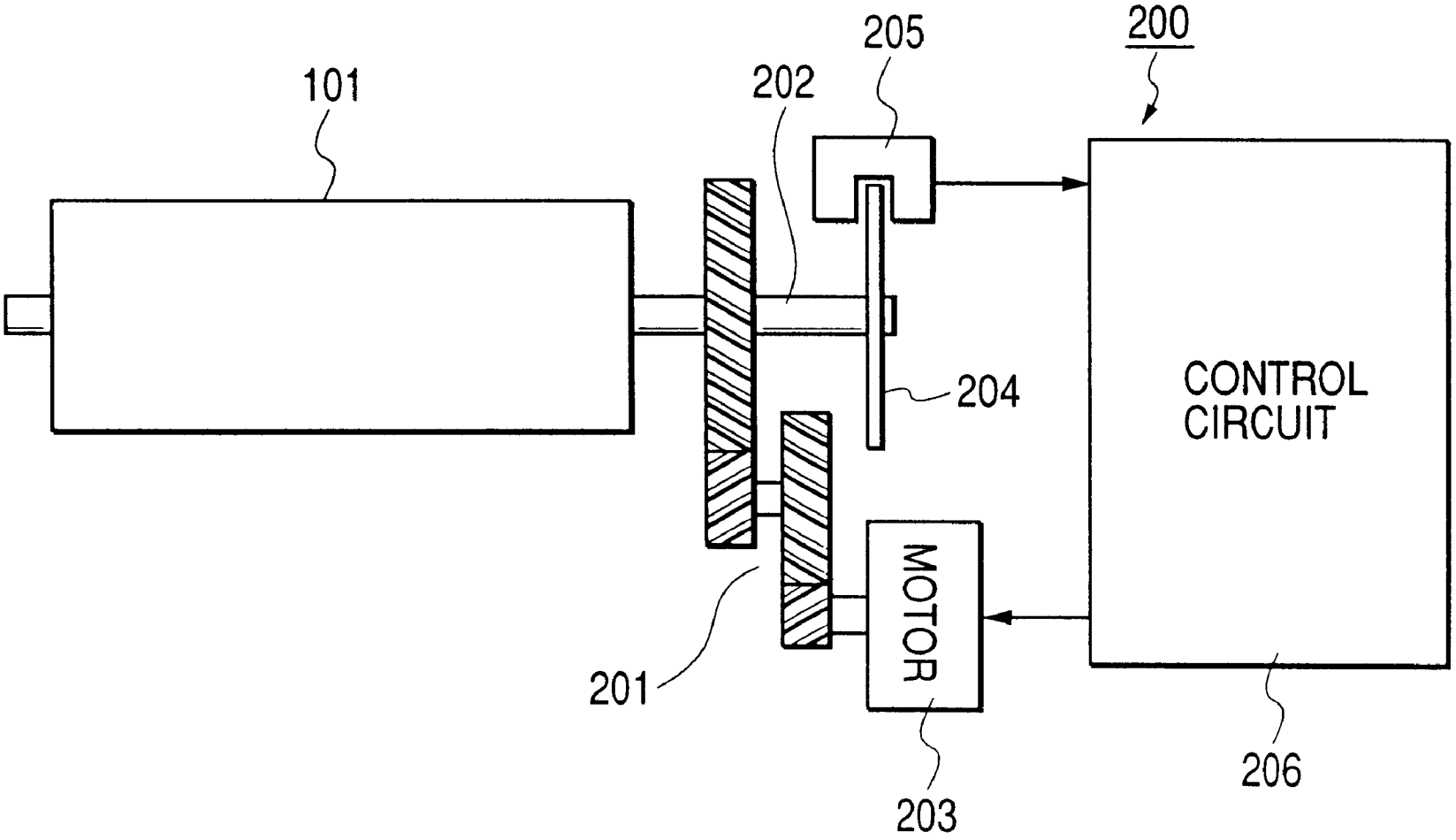
FIG. 2 is a view showing the structure of a photosensitive drum driving portion in the apparatus shown in FIG. 1.

FIG. 2 is a view showing the structure of the driving unit 200 for each photosensitive drum 101 in the apparatus shown in FIG. 1. Identical driving units (FIG. 2) are arranged for Y, M, C, and BK, respectively, and perform the same operation.

Referring to FIG. 2, a reduction gear 201 transmits the rotation of a motor 203 to a rotating shaft 202. The rotating shaft 202 rotates together with the photosensitive drum 101. The motor 203 is comprised of a stepping motor. A code wheel 204 has concentric equiangular slits and rotates together with the rotating shaft 202. An encoder 205 is made up of light-receiving and light-emitting portions and generates a pulse when each slit of the code wheel 204 passes through the encoder 205. A control circuit 206 controls rotation operation of the motor 203 on the basis of pulses from the encoder 205.

Referring to FIG. 2, the rotation of the motor 203 is transmitted to the rotating shaft 202 through the reduction gear 201 to rotate the photosensitive drum 101. At the same time, the code wheel 204 rotates upon rotation of the rotating shaft 202. During rotation of the code wheel 204, the encoder 205 generates pulses and outputs them to the control circuit 206. The control circuit 206 controls the rotation of the motor 203 on the basis of the pulses from the encoder 205.

Figure 3:
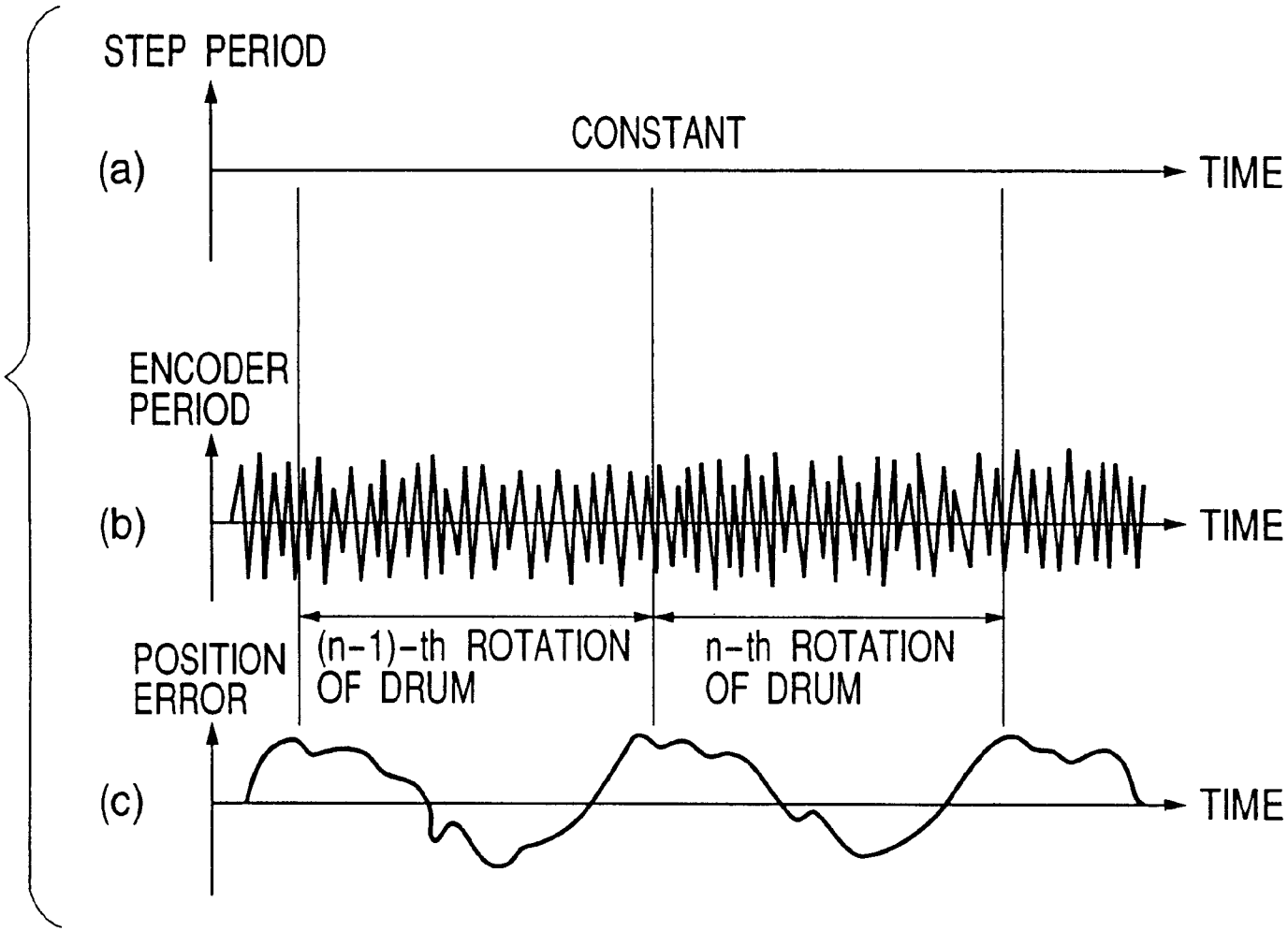
FIG. 3 is a chart for explaining control operation for a photosensitive drum.

FIG. 3 is a chart for explaining rotation errors of the photosensitive drum 101 when control for correcting rotation of the motor 203 is not performed. In FIG. 3, (a) represents the state of the control step of the motor 203, (b) represents transition in period of the output pulses from the encoder 205, and (c) represents rotation position error of the drum 101, which is obtained by integrating the output pulse periods (b) of the encoder 205.

As shown in FIG. 3, when constant control data is applied to the motor 203, the rotation state within one rotation of the photosensitive drum 101 is not constant due to the rotation error of the motor 203 and dimensional error (meshing error) of the reduction gear 201. The output pulse period of the encoder 205 varies to periodically generate rotation position errors. The phase and amplitude of the rotation position error change in units of colors, thus resulting in periodic color misregistration (unsteady error). In this embodiment, the rotation cycle of the reduction gear 201 and motor 203 is set to a fraction of an integer of one rotation of the photosensitive drum 101. The rotation errors are repeated at the rotation period of the photosensitive drum 101.

Figure 4:
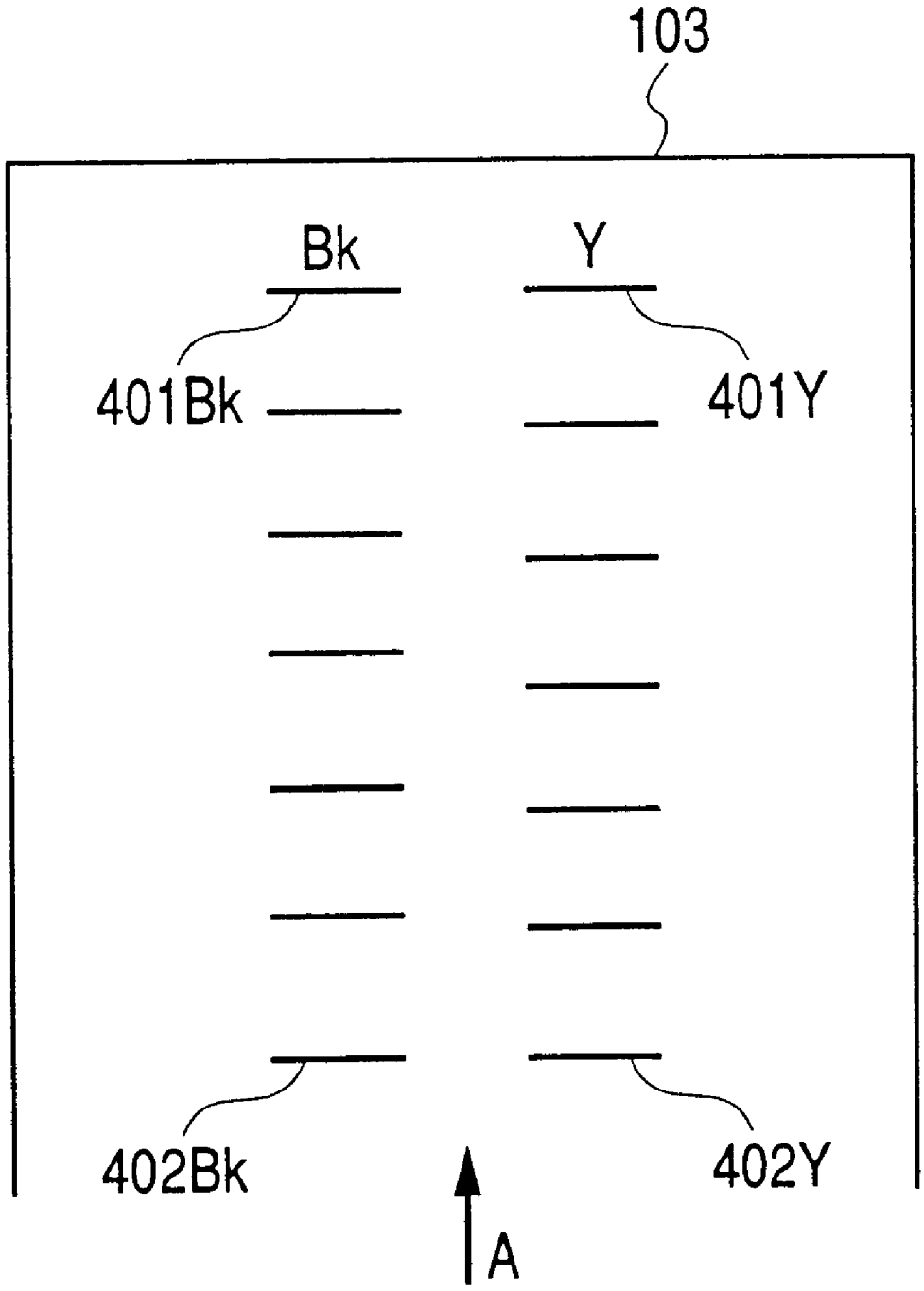
FIG. 4 is a view for explaining an unsteady error.

FIG. 4 is a view showing sub-scanning unsteady color misregistration based on rotation errors of the photosensitive drum 101.

FIG. 4 shows that color misregistration has occurred in BK and Y. The total moving amount of BK, i.e., the distance between 401BK and 402BK is equal to the total moving amount of Y, i.e., the distance between 401Y and 402Y. However, the phase and amplitude of rotation error of BK are different from those of Y. The sub-scanning positions of each line between 401BK and 402BK do not match those between 401Y and 402Y, thus resulting in periodic color misregistration.

In this embodiment, the control circuit 206 in FIG. 2 controls the motor 203 to prevent periodic color misregistration.

Figure 5:
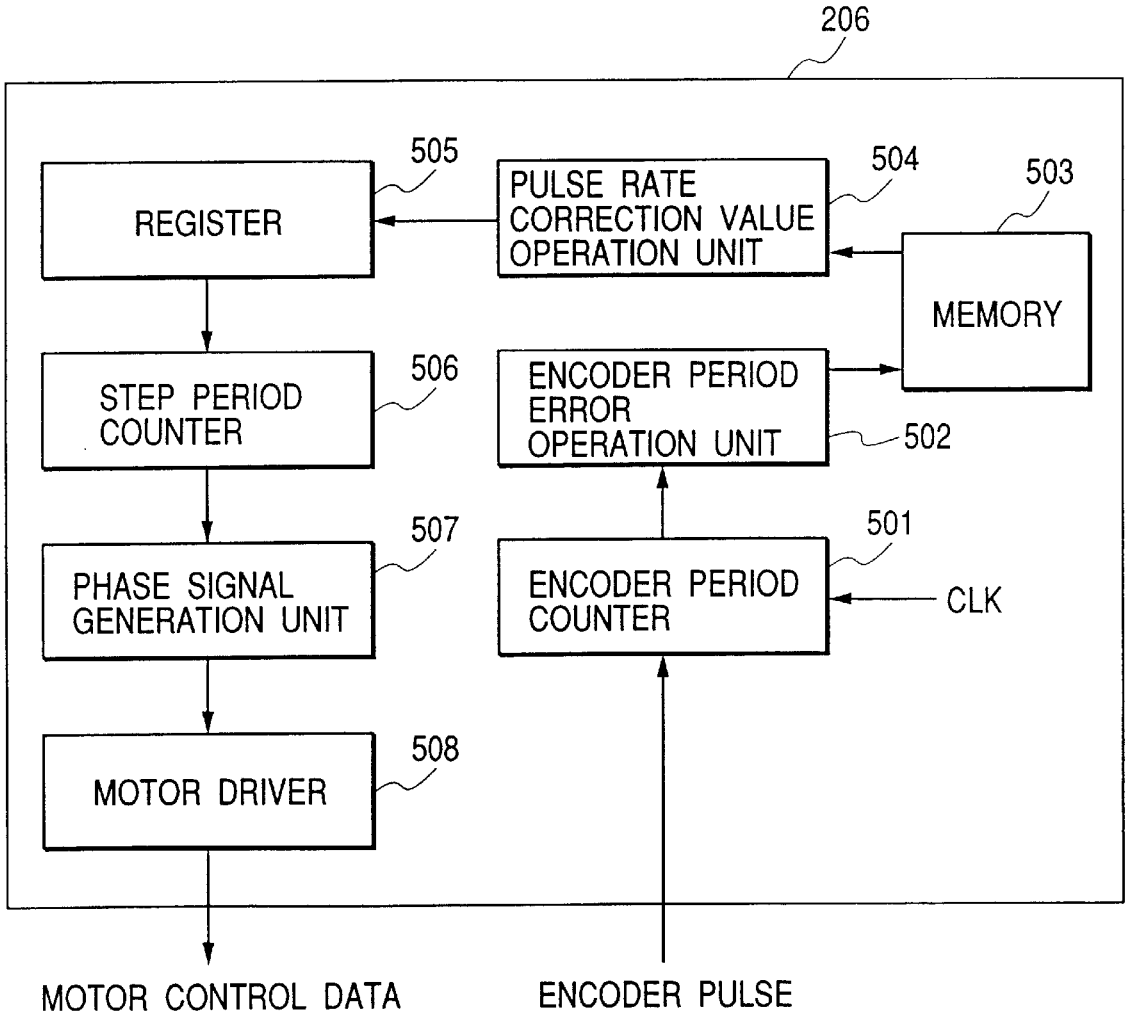
FIG. 5 is a block diagram showing the arrangement of a control circuit in FIG. 2.

FIG. 5 is a block diagram showing the arrangement of the control circuit 206.

Referring to FIG. 5, output pulses from the encoder 205 are output to an encoder period counter 501. In this embodiment, the code wheel 204 has 1,000 slits, and the encoder 205 outputs 1,000 pulses upon one rotation of the photosensitive drum 101. The counter 501 counts clocks CLK having a predetermined period on the basis of the encoder output pulses and outputs each encoder pulse period as a clock count value for each pulse.

An encoder period error operation unit 502 compares the period data of each encoder pulse output from the counter 501 with reference data and stores an error as the difference between them in a memory 503.

A pulse rate correction value operation unit 504 calculates a correction value for canceling the error of the period data of each encoder pulse on the basis of the error data (stored in the memory 503) of the period data of the encoder pulses within a predetermined interval centered on the same rotation position of the immediately preceding rotation as that of the current rotation, and the step period of the encoder pulse at the same rotation position of the immediately preceding rotation as that of the current rotation. A non-periodic high-frequency component caused by the tooth pitch of the reduction gear 201 is filtered using the above correction value within the predetermined period to obtain correction data. The correction data is output to a register 505. As a filter used in the above filtering operation, an averaging process of correction values, FIR filter, IIR filter, or the like can be used.

The register 505 outputs this correction data to a step period counter 506. The counter 506 changes the count value on the basis of this correction data. The counter 506 outputs a pulse at the period of the corrected count value to a phase signal generation unit 507. The phase signal generation unit 507 generates a phase signal on the basis of the output from the counter 506 and outputs it to a motor driver 508. The motor driver 508 drives the stepping motor 203 on the basis of the phase signal.

The stepping motor 203 in this embodiment is a hybrid type two-phase stepping motor having 200 steps per rotation. The theoretical driving rate of the stepping motor 203 is 2,000 pps. However, the control circuit 206 controls the stepping motor 203 in the manner as described above, and the stepping motor is driven at a corrected variable step period centered on the theoretical value.

Figure 6:
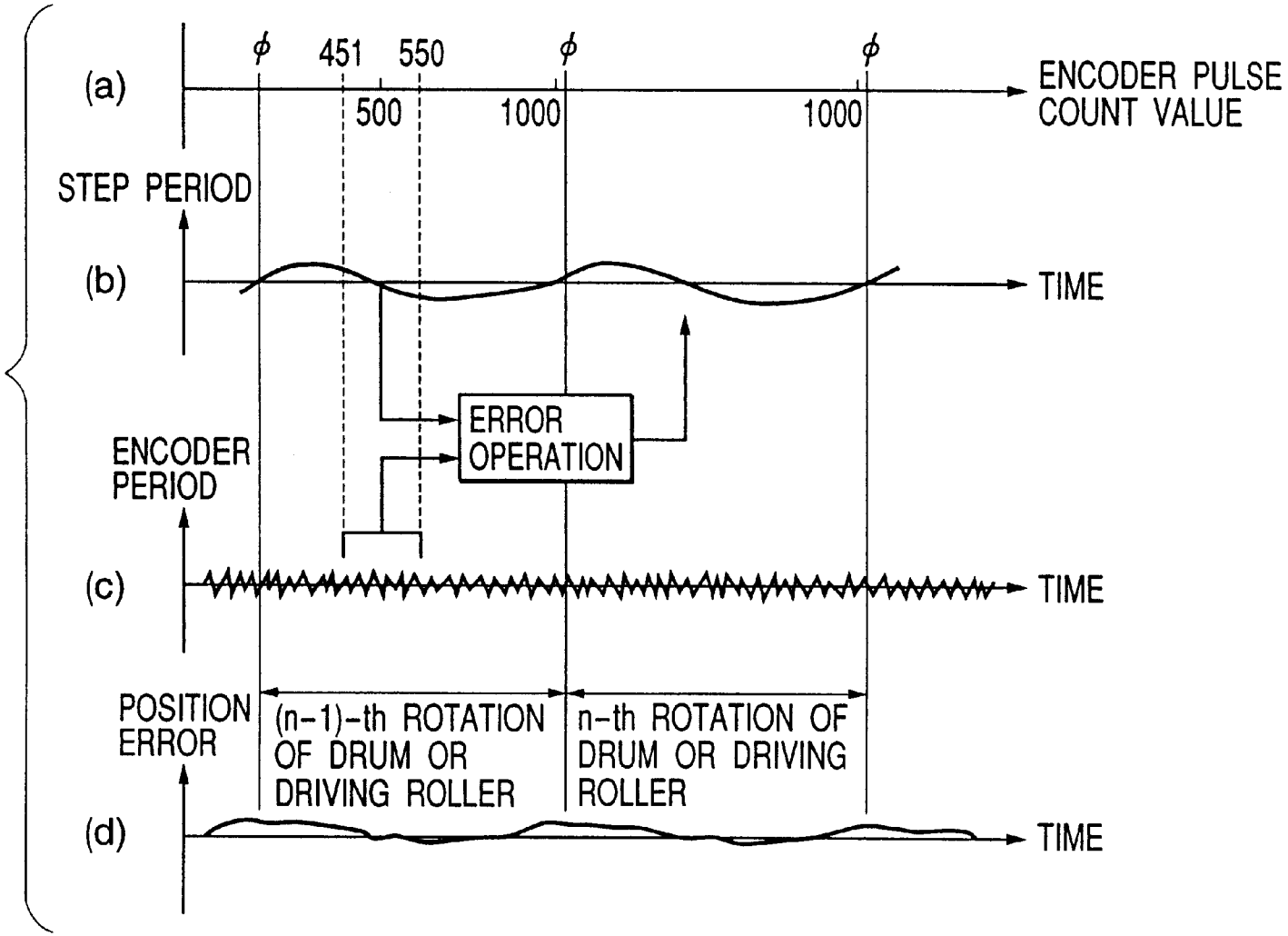
FIG. 6 is a chart for explaining control operation for the photosensitive drum having the structure shown in FIG. 2.

FIG. 6 is a chart for explaining the relationship between the error of the output pulse period of the encoder 205 and the correction value of the step period of the stepping motor 203, and the rotation error of the photosensitive drum 101 after correction in this embodiment.

Referring to FIG. 6, (a) represents the encoder pulse count value. The encoder generates 1,000 pulses per rotation. In addition, (b) represents the control step period state of the stepping motor 203, (c) represents the transition in output pulse period of the encoder 205, and (d) represents the rotation position error of the drum 101, which is obtained by integrating the output pulse periods (b) of the encoder 205.

For example, the current rotation position in FIG. 6 is represented by an encoder pulse count of 500. At this time, the control step period of the stepping motor 203 at the encoder pulse count of 500 in n-th rotation is controlled on the basis of the error data of the encoder pulse period at the same position of the immediately preceding rotation as that of the current rotation, that is, the error data in a predetermined interval centered on the encoder pulse count of 500 in the (n−1)-th rotation as the immediately preceding rotation of the n-th rotation of the photosensitive drum 101, as shown in (a) of FIG. 6, i.e., in an interval corresponding to 100 pulses in the pulse count range of 451 to 550, and on the basis of the control step period of the stepping motor 203 at the same rotation position of the immediately preceding rotation as that of the current rotation. The error from the reference value is thus canceled.

Similarly, for example, when the current rotation position is represented by an encoder pulse count of 550, the control step period of the stepping motor at the encoder pulse count of 550 in the n-th rotation is controlled on the basis of the error data of the encoder pulse period at the same position of the immediately preceding rotation as that of the n-th rotation, i.e., in the encoder pulse count range of 501 to 600 centered on the encoder pulse count of 550, and the control step period of the stepping motor 203 at the same position of the immediately preceding rotation as that of the n-th rotation.

With the above control, the variations in position of the photosensitive drum 101 can be reduced, as shown in (d) of FIG. 6, thereby preventing periodic image color misregistration.

As described above, according to this embodiment, since the encoder pulse period error of the predetermined interval including the same rotation position of the immediately preceding rotation as that of the current position is used, control can immediately respond to variations in rotation errors, and the load of the operation for correcting encoder pulse period error can be reduced.

The encoder pulse error values within the predetermined interval are filtered within the predetermined interval, and motor can be stably controlled.

The length of the predetermined interval can be appropriately changed to allow a change in response speed of motor control to the change in encoder pulse period.

The second embodiment of the present invention will be described below.

In the above embodiment, as shown in FIG. 6, the step period in the current, i.e., n-th rotation is controlled on the basis of the error of the encoder pulse period of the specific period in the (n−1)-th rotation immediately preceding the n-th rotation and the step period data. In addition to this, the second embodiment uses the error of the encoder pulse period in a predetermined interval immediately preceding a specific rotation position in the current, i.e., n-th rotation.

In this embodiment, the arrangement of a driving unit is the same as that shown in FIG. 2, and the arrangement of a control circuit 206 is the same as that shown in FIG. 5.

Figure 7:
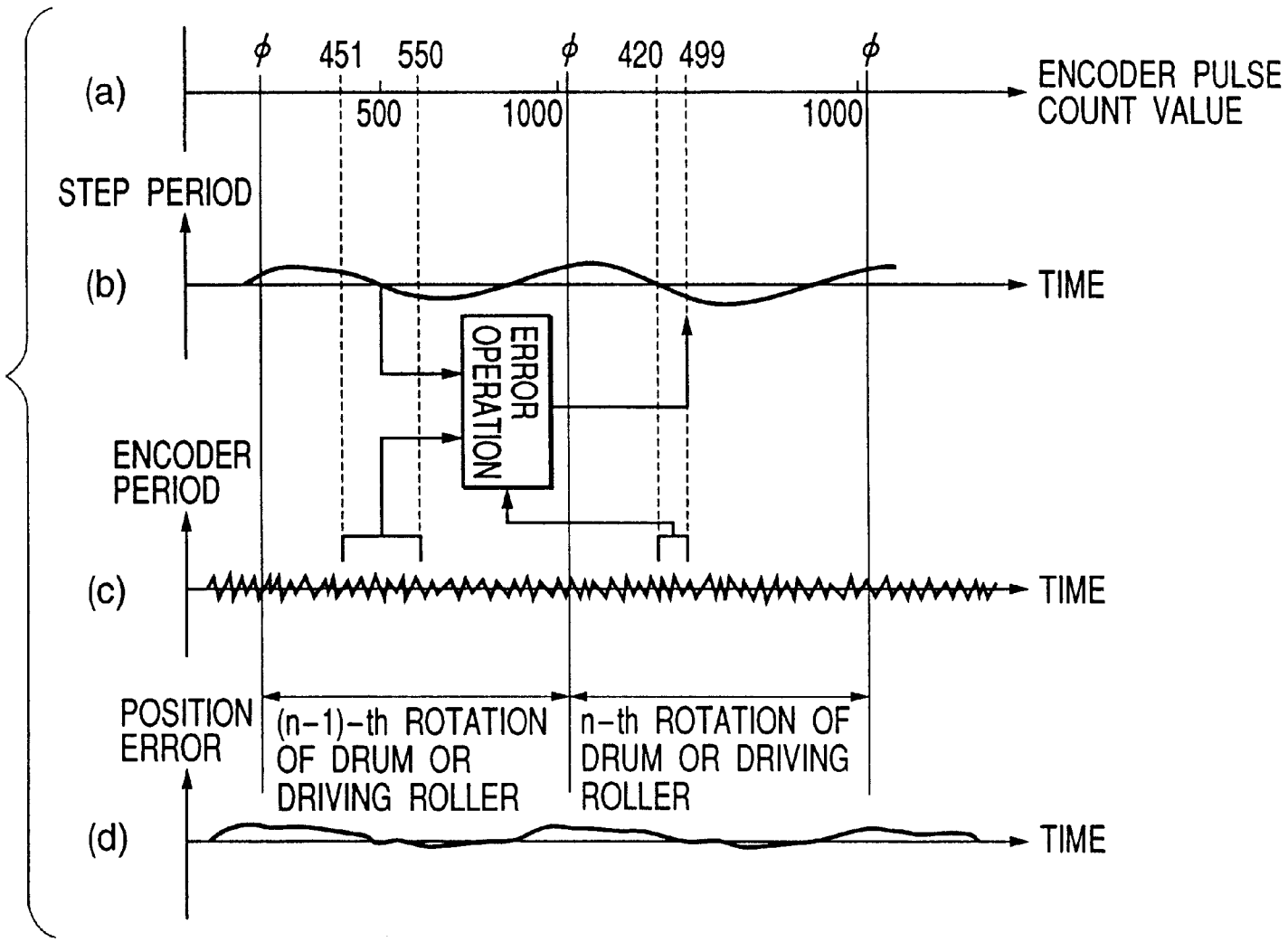
FIG. 7 is a chart for explaining control operation for a photosensitive drum according to the second embodiment of the present invention.

In the second embodiment, as shown in (a) of FIG. 7, in addition to the encoder pulse period errors at the same position of the (n−1)-th rotation as that of the n-th rotation, e.g., in a predetermined interval including an encoder pulse count of 500, i.e., in the encoder pulse count range of 451 to 550, the encoder pulse period errors in a predetermined interval immediately preceding the current rotation position in the n-th rotation, e.g., in the encoder pulse count range of 420 to 499 are also used. On the basis of these data and the step period in the specific interval of the immediately preceding rotation, the step period of the current rotation is controlled to cancel the encoder pulse period data errors.

More specifically, in the control circuit 206 of FIG. 5, a pulse rate correction value operation unit 504 reads out, from a memory 503, the encoder pulse period error values of the predetermined interval centered on the same position of the immediately preceding rotation as that of the current rotation and the encoder pulse period error values of the predetermined interval immediately preceding the current rotation position in the current rotation. The error value for each encoder pulse in each interval is filtered, and the filtered data is appropriately weighted in consideration of the response of the driving/transmitting mechanism.

The step period correction value is obtained on the basis of the each encoder pulse period error data and the step period at the same rotation position of the immediately preceding rotation as that of the current rotation. The step period correction value is output to a register 505. The subsequent processing is the same as in the first embodiment. A motor driver 508 controls the stepping motor 203 on the basis of the corrected step period.

As described above, in the second embodiment, the step period is controlled on the basis of the encoder pulse period errors of the predetermined interval immediately preceding the current rotation position in the current rotation in addition to the encoder pulse period errors in the predetermined interval including the same rotation position of the immediately preceding rotation as that of the current rotation. As compared with the first embodiment, the step period of the photosensitive drum can be controlled with higher precision. The image color misregistration caused by the non-periodic errors can be eliminated.

The third embodiment of the present invention will be described below.

Figure 8:
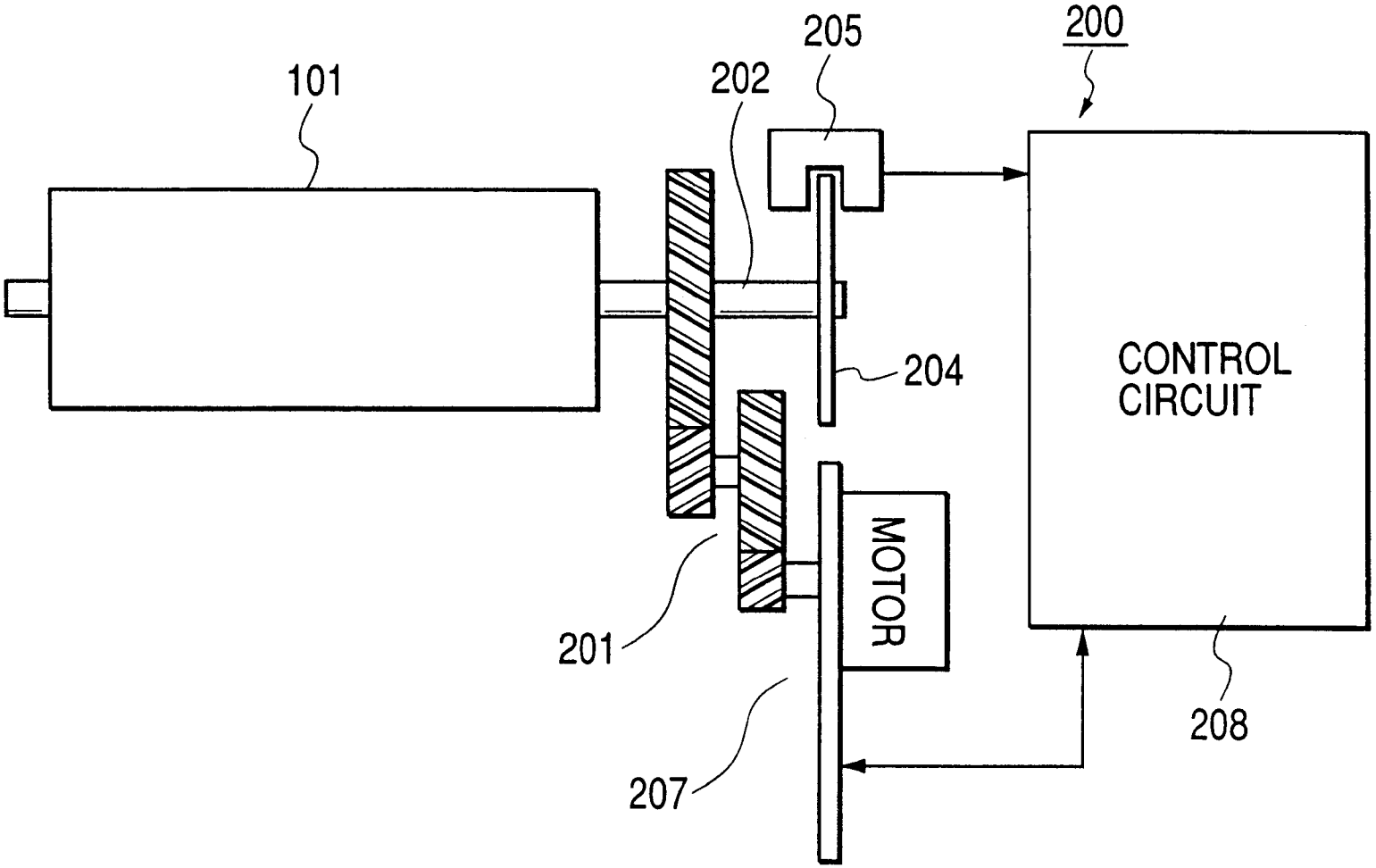
FIG. 8 is a view showing another structure of the photosensitive drum driving portion in the apparatus shown in FIG. 1.

FIG. 8 is a view showing the structure of a driving unit 200 according to the third embodiment of the present invention.

Referring to FIG. 8, a reduction gear 201, rotating shaft 202, code wheel 204, and encoder 205 are identical to those in FIG. 2. A DC brushless motor 207 rotates photosensitive drum 101 through the reduction gear 201. During this rotation, the DC brushless motor 207 generates an FG pulse and outputs it to a control circuit 208. The control circuit 208 controls rotation of the motor 207 on the basis of the output pulse from the encoder 205 and the FG pulse from the motor 207.

Figure 9:
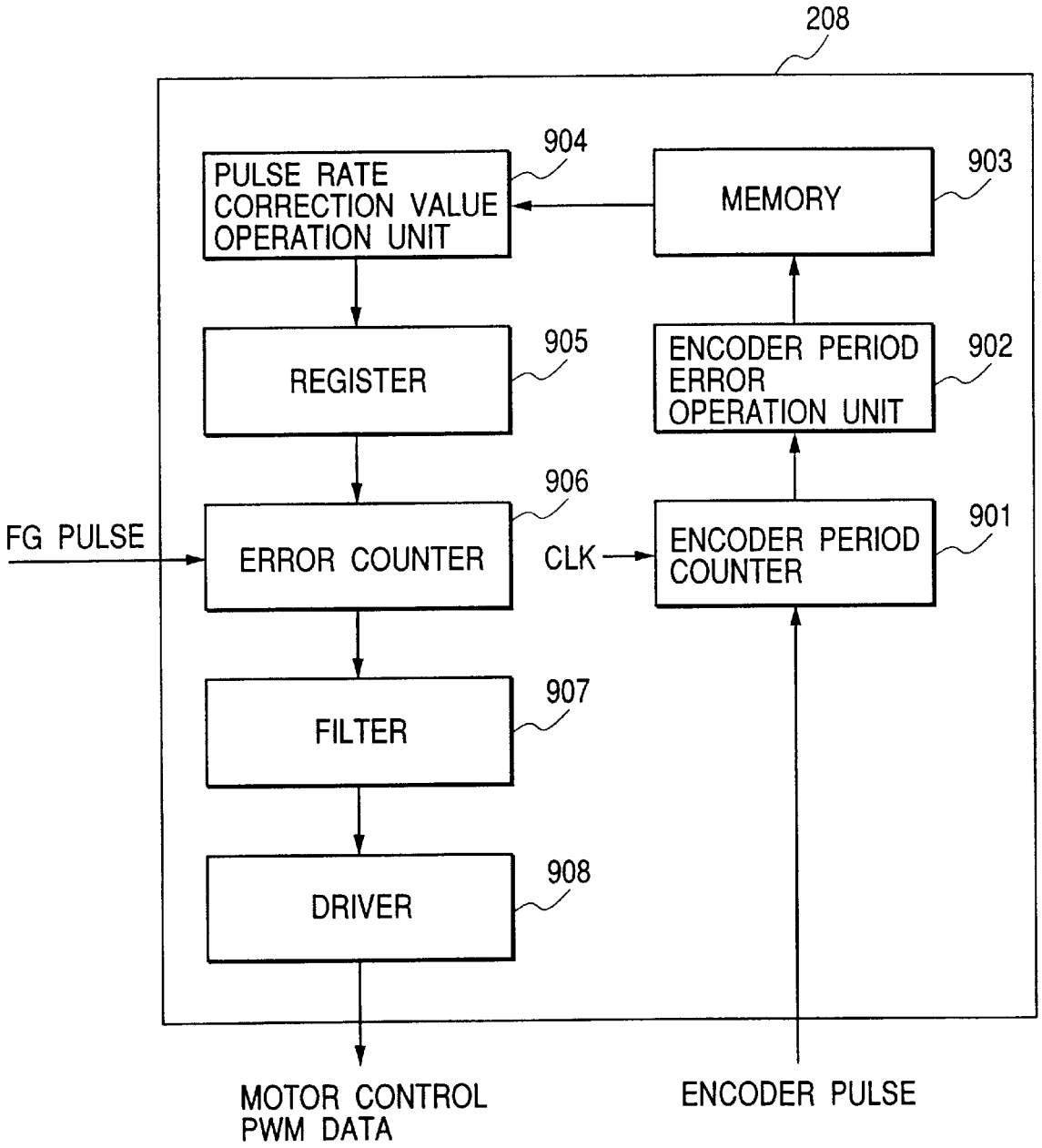
FIG. 9 is a block diagram showing the arrangement of a control circuit in FIG. 8.

FIG. 9 is a block diagram showing the arrangement of the control circuit 208.

Referring to FIG. 9, an output pulse from the encoder 205 is output to an encoder period counter 901. In this embodiment, the code wheel 204 has 1,000 slits. The encoder 205 generates 1,000 pulses per rotation of the photosensitive drum 101. The counter 901 counts clocks CLK having a predetermined frequency on the basis of the encoder output pulse and outputs each encoder pulse period as the clock count value for each pulse.

An encoder period error operation unit 902 compares each encoder pulse period data output from the counter 901 with reference data, and stores an error as the difference between them in a memory 903.

A pulse rate correction value operation unit 904 calculates a correction value to cancel the rotation error of the motor 207 on the basis of the error data (stored in the memory 903) of the encoder pulse period data in a predetermined interval centered on the same rotation position of the immediately preceding rotation as that of the current rotation of the photosensitive drum and the control data of the same rotation position of the immediately preceding rotation of the DC motor 207. The pulse rate correction value operation unit 904 then filters non-periodic high-frequency component caused by the tooth pitch of the reduction gear 201 in the predetermined period to obtain correction data. The pulse rate correction value operation unit 904 outputs the correction data to a register 905. As a filter used in the above filtering operation, an averaging process of correction values, FIR filter, IIR filter, or the like can be used.

An error counter 906 compares the correction data stored in the register 905 with the period of the FG pulse from the motor 207 and outputs error data as the difference between them to a filter 907. The filter 907 performs gain adjustment and phase compensation for the output data from the error counter 906 and outputs the resultant data to a driver 908. The driver 908 converts the error data from the filter 907 into a PWM signal and outputs the PWM signal to the motor 207.

In this embodiment, the motor 207 has a rotation speed of 1,200 rpm, and 100 FG pulses are output per rotation of the motor. The theoretical reference pulse frequency is 2 kHz (1200 rpm/60×100). Since the motor 207 is controlled by the control circuit 208 as described above, the motor 207 is driven in the corrected value range centered on the theoretical value.

As described above, even if the DC motor is used in place of the stepping motor, rotation driving of the photosensitive drum can be controlled in the same manner as in the above embodiments, thereby eliminating image color misregistration caused by the non-periodic errors.

In the above embodiment, the encoder pulse period errors in the predetermined interval including the same rotation position of the immediately preceding rotation as that of the current rotation are used. However, the encoder pulse period errors in the predetermined interval of a plurality of rotations immediately preceding the current rotation may be used, and their average value or weighted data may be used.

In the above embodiment, the driving unit 200 shown in FIG. 2 or 8 is used to control rotation driving of the photosensitive drum 101. However, the driving unit 200 may be used to control rotation driving of the driving roller 104 of the conveyor belt in FIG. 1.

The latent image is formed on each photosensitive drum in the apparatus of FIG. 1. However, a photosensitive body on a belt may be used in place of the photosensitive drum. In this case, the arrangement shown in FIG. 2 or 8 can be applied to rotation control of the driving roller.

The motor of the driving source may be any other motor such as a DC servo motor with a brush.

The encoder may be a reflection encoder in place of an optical encoder.

An encoder assembly need not be made up of the code wheel and optical encoder, but may be a magnetic rotary encoder using an MR element and the like.

In each embodiment described above, an image is formed using a light beam. However, the present invention is also applicable to an apparatus for forming an image using, e.g., an LED head.

In each embodiment described above, although the rotation cycle of the reduction gear and motor is set to a fraction of an integer of one rotation of the photosensitive drum, conveyor belt, and driving roller, the rotation cycle may be set to a fraction of an integer of two rotations of the photosensitive drum and conveyor belt driving roller. In this case, two rotations of the photosensitive drum and conveyor belt driving roller are defined as one cycle, and control shown in FIG. 5 or 6 may be performed for preceding and succeeding predetermined intervals as targets centered on the same rotation position of the immediately preceding rotation cycle as that of the current rotation.

Each control circuit shown in FIG. 5 or 9 can be implemented by software using a microcomputer.

As has been described above, according to each embodiment, an unsteady error based on rotation errors of the rotary members can be prevented, and a high-precision image can be obtained.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus comprising:

image forming means including an image carrier and write means for forming an image on the image carrier;

a moving member which moves to transfer, at a transfer position, the image formed on the image carrier;

driving means for rotating and driving the image carrier; and control means for controlling rotation driving of said driving means on the basis of a rotation state of the image carrier obtained during a predetermined time interval centered on the same rotation position of a preceding rotation as that of a current rotation.

2. An apparatus according to claim 1, wherein said control means further controls rotation driving of said driving means on the basis of a driving signal for driving said driving means at the same rotation position of a preceding rotation as that of the current rotation.

3. An apparatus according to claim 1, wherein said control means further controls rotation driving of said driving means on the basis of a rotation state of the image carrier in an interval immediately preceding the current rotation position.

4. An apparatus according to claim 1, wherein said control means controls rotation driving of said driving means on the basis of a rotation state of the image carrier for a plurality of rotations in the predetermined time interval centered on the same rotation position of the preceding rotation as that of the current rotation.

5. An apparatus according to claim 1, wherein said control means controls rotation driving of said driving means on the basis of a rotational speed error of said driving means in the predetermined time interval.

6. An apparatus according to claim 5, wherein said control means comprises speed error detection means for detecting a rotational speed error of said driving means in the predetermined time interval and filter means for filtering an output from said speed error detection means, and controls rotation driving of said driving means on the basis of an output from said filter means.

7. An apparatus according to claim 5, wherein said control means outputs a control signal to said driving means so as to cancel the rotational speed error.

8. An apparatus according to claim 1, wherein said control means comprises an encoder for generating a pulse during rotation of the image carrier, and controls rotation driving of said driving means on the basis of a period of the encoder pulse in the predetermined time interval.

9. An apparatus according to claim 8, wherein said control means comprises error detection means for comparing the period of the encoder pulse in the predetermined time interval with a reference period and detecting an error between the period of the encoder pulse and the reference period, and controls rotation driving of said driving means on the basis of an output from said error detection means.

10. An apparatus according to claim 1, wherein said driving means comprises a stepping motor.

11. An apparatus according to claim 10, wherein said control means changes a driving step period of said stepping motor on the basis of the rotation state of the image carrier in the predetermined time interval.

12. An apparatus according to claim 1, wherein said driving means comprises a DC brushless motor.

13. An apparatus according to claim 1, wherein said driving means comprises a driving source and a transmission mechanism for transmitting a driving force from said driving means to the image carrier.

14. An apparatus according to claim 1, wherein the predetermined time interval has a changeable length.

15. An apparatus according to claim 1, wherein said image forming means comprises a plurality of image forming means, and said driving means comprises a plurality of driving means respectively corresponding to said plurality of image forming means.

16. An apparatus according to claim 1, wherein said control means performs the control operation by software using a microcomputer.

17. An image forming apparatus comprising:

a plurality of image forming means each including an image carrier and write means for writing an image on the image carrier;

a moving member which moves to transfer, at a transfer position, the image formed on each image carrier in each of said plurality of image forming means;

rotation driving means for conveying and driving said moving member; and control means for controlling rotation driving of said rotation driving means on the basis of a rotation state of said rotation driving means obtained during a predetermined time interval centered on the same rotation position of a preceding rotation as that of a current rotation.

18. An image forming apparatus, comprising:

an image carrier;

forming means for forming an image on said image carrier;

driving means for rotating said image carrier;

speed detection means for detecting a rotation speed of said image carrier driven by said driving means;

storing means for storing in memory information about the rotation speed of said image carrier detected by said speed detection means;

speed error detection means for detecting a rotation speed error of said image carrier based on the information stored in said memory; and control means for controlling said driving means based on the rotation speed error of a preceding rotation period of said image carrier, detected by said speed error detection means.

19. An image forming apparatus according to claim 18, further comprising:

output means for outputting a pulse signal in synchronism with rotation of said image carrier, wherein said speed detection means detects the rotation speed of said image carrier based on the pulse signal output by said output means.

20. An image forming apparatus according to claim 18, further comprising:

filtering means for filtering the information about the rotation speed of said image carrier.

21. An image forming apparatus according to claim 18, wherein said driving means includes a stepping motor.

22. An image forming apparatus according to claim 21, wherein said control means changes a driving step cycle period of said stepping motor.

23. An image forming apparatus according to claim 18, wherein said control means controls said driving means based on the information about the rotation speed error prior to one rotation of said image carrier.

24. An image forming apparatus according to claim 18, wherein said control means controls said driving means based on the information about rotation speed error in substantially the same rotational position as a present rotational position.

25. A method of controlling an image forming apparatus for forming an image on an image carrier, comprising:

a driving step of rotating the image carrier;

a speed detection step of detecting a rotation speed of the image carrier driven in said driving step;

a storing step of storing in memory information about the rotation speed of the image carrier detected in said speed detection step;

a speed error detection step of detecting a rotation speed error of the image carrier based on the information stored in the memory; and a control step of controlling a rotation driving condition of the image carrier based on the rotation speed error of a preceding rotation period of said image carrier detected in said speed error detection step.

26. A method according to claim 25, further comprising:

an output step of outputting a pulse signal in synchronism with rotation of the image carrier, wherein said speed detection step includes detecting the rotation speed of the image carrier based on the pulse signal output in said output step.

27. A method according to claim 25, further comprising:

a filtering step of filtering the information about the rotation speed of the image carrier.

28. A method according to claim 25, wherein said driving step includes rotating the image carrier using a stepping motor.

29. A method according to claim 28, wherein said control step includes changing a driving step cycle period of the stepping motor.

30. A method according to claim 25, wherein said control step includes controlling the rotation driving condition of the image carrier based on the information about rotation speed error prior to one rotation of the image carrier.

31. A method according to claim 25, wherein said control step includes controlling the rotation driving condition of the image carrier based on the information about rotation speed error in substantially the same rotational position as a present rotational position.

32. An image forming apparatus, comprising:

an image carrier;

forming means for forming an image on said image carrier;

driving means for rotating said image carrier;

output means for outputting a signal in synchronism with rotation of said image carrier;

detecting means for detecting a rotation speed error of said image carrier based on an output of said output means;

storing means for storing in memory information about the rotation speed error of said image carrier detected by said detecting means;

filtering means for filtering the information about the rotation speed error of said image carrier detected by said detecting means; and control means for controlling said driving means based on the information filtered by said filtering means and stored in said memory.

33. A method of controlling an image forming apparatus for forming an image on an image carrier, comprising:

a driving step of rotating the image carrier;

an output step of outputting a signal in synchronism with rotation of the image carrier;

a detecting step of detecting a rotation speed error of the image carrier based on an output in said output step;

a storing step of storing in memory information about the rotation speed error of the image carrier based on the signal output in said output step;

a filtering step of filtering an output in said detecting step; and a control step of controlling a rotation driving condition of the image carrier based on information filtered in said filtering step and stored in the memory.

* * * * *